United States Patent [19]

Scott et al.

[11] 3,932,951

[45] Jan. 20, 1976

[54] TRENCH DIGGING MACHINERY

[76] Inventors: Louie B. Scott; Ellery A. Scott, both of P.O. Box 237, Lonoke, Ark. 72086

[22] Filed: Nov. 27, 1974

[21] Appl. No.: 527,833

[52] U.S. Cl. ..... 37/86; 37/191 A

[51] Int. Cl.[2] ..... E02F 5/06

[58] Field of Search ..... 37/86, 191 A, 192 A, 84, 37/85

[56] References Cited

UNITED STATES PATENTS

| | | | |
|---|---|---|---|
| 2,709,860 | 6/1955 | Helton | 37/191 A |
| 3,050,881 | 8/1962 | Brown | 37/191 A X |
| 3,570,152 | 3/1971 | Schuermann et al. | 37/86 |
| 3,754,341 | 8/1973 | Caldwell et al. | 37/86 |
| 3,846,922 | 11/1974 | Horton | 37/191 A X |

FOREIGN PATENTS OR APPLICATIONS

| | | | |
|---|---|---|---|
| 1,133,509 | 11/1968 | United Kingdom | 37/191 A |

*Primary Examiner*—Stephen C. Pellegrino
*Attorney, Agent, or Firm*—Raymond N. Matson

[57] ABSTRACT

Particular tooth assembly structure is presented for a trench digging machine powered to cyclically present a series of digging teeth as the machine moves forward to dig the trench. The teeth are shaped to produce a semi-circular trench bottom and each is of a size and length such that the power load for digging by each tooth is substantially evenly distributed.

6 Claims, 5 Drawing Figures

TRENCH DIGGING MACHINERY

This invention relates generally to trench digging machines and more particularly it relates to power driven excavating teeth arrayed in a sequential cyclic pattern for digging a trench of a particular shape.

Trench digging machines are well known in the art. Representative of the state of the art are commercially available machines of the chain link type provided by Davis Manufacturing Company of Wichita, Kansas, or of the solid wheel type provided by Parsons Division of Koehring Company of Newton, Iowa, and patented art such as U.S. Pat. No. 2,519,076 relating to Trench Digger Blade Construction, issued Aug. 15, 1950.

There are in prior art devices however, certain deficiencies and problems presented that are not adequately resolved prior to this invention. For example, it is difficult with prior art devices to provide a clean trench that has a smooth worked finish with a semi-circular bottom shape. Also in digging trenches, particularly with low powered vehicles, it is pertinent to efficiently distribute the digging load over a multiplicity of cyclically presented digging teeth to prevent stalling and jerking. In addition where chain link type drive mechanisms are used, the digging tooth load, moment and posture is not held optimum as the teeth are loaded in the digging operation, tending to cause overdesign of the chain and teeth to prevent rupture, bending and tilt. Other problems presented by cyclically power driven digging tooth assemblies of the prior art include the handling of spoil as it is dug, and the cleaning and loosening of spoil from the teeth.

Accordingly, it is a primary object of this invention to resolve the foregoing problems of the prior art with improved trench digging machinery having specially designed digging teeth sequentially presented to reduce the intermittent power drive load requirements.

Another object of the invention is to provide trench digging tooth structure which has particular advantage if employed with chain link drive mechanisms.

Other objects of the invention include provision of digging tooth structure in a trench digging machine for making a semi-circular trench bottom, for providing a smooth finish to the trench, and for more reliably cleaning and presenting the teeth in a cyclic digging operation.

Therefore, in accordance with this invention a series of trench digging tooth assemblies are provided for attachment to a wheel or chain in a sequence that causes the digging load to be substantially equally distributed over the successive teeth as they are moved along a trench by a powered vehicle. Thus, the tooth structure is varied in both bite size and length over the cyclically presented sequence. The teeth are shaped to take a substantially circular bite to thereby round the trench bottom in a smooth finished surface so that a follower crumbing blade need be loaded only to the extent of confining spoil and need not shape the surface. Tooth assembly structure includes drag plates for transporting spoil from the digging site and moment transfer plates for distributing load on a chain link drive and maintaining tooth posture during loading conditions.

Further features, objects and advantages of the invention will be made apparent from a reading of the following description and accompanying drawings.

In the drawings, one preferred embodiment of the invention is shown, wherein.

Figure 1:
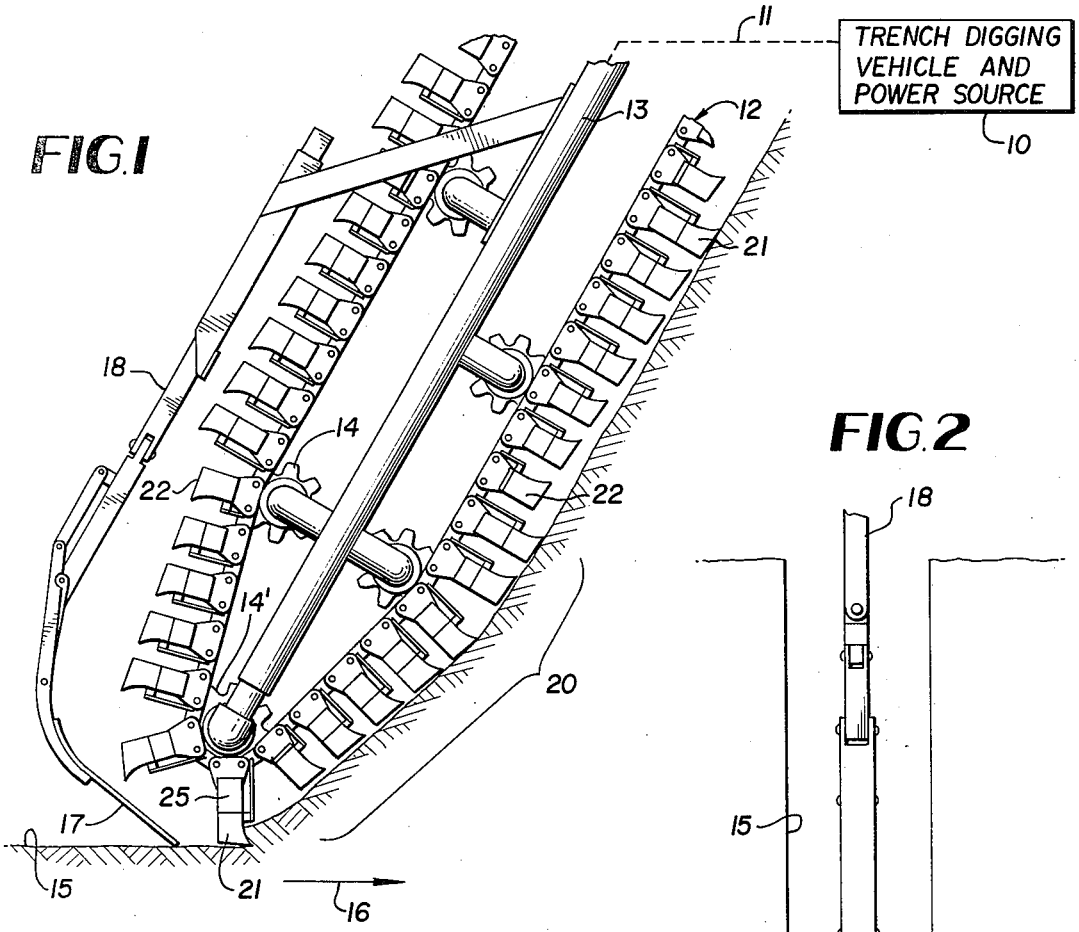
FIG. 1 is a partially cutaway view in elevation of a chain driven trench digging mechanism in digging position in a trench and showing in block schematic form the accompanying digging vehicle and power source.

With more specific reference to the drawings, like reference characters in the various views represent similar features for purposes of ready comparison. In the overall relationship shown in FIG. 1, the trench digging vehicle and power source 10, as such, may be conventional of the type hereinbefore referred to and therefore to more particularly point out the nature of the improvements of this invention, is shown schematically with dotted line 11 indicating that the vehicle will power the chain link drive 12 through boom 13 and around sprockets 14 and move the vehicle and cyclically moving tooth assembly forward along a trench 15 in the direction of arrow 16. For more clarity in showing the inventive features, the spoil removed in digging the trench is not shown.

Figure 2:
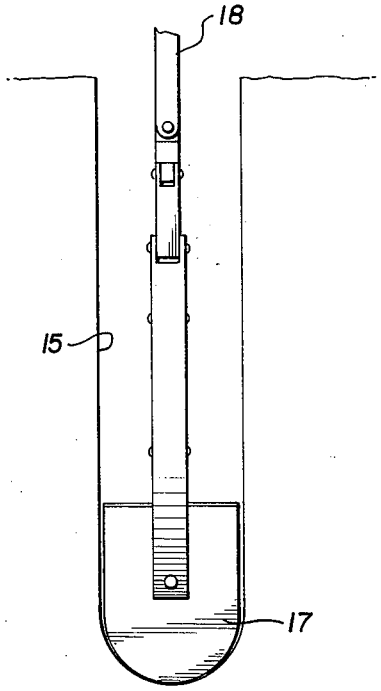
FIG. 2 is a partial end view, partly broken away, looking into the trench from behind the trench digging mechanism.

As may be seen from also viewing FIG. 2, the cyclically movable teeth are followed by a crumbing blade 17 retained by assembly 18. The crumbing blade 17 has a semi-circular bottom edge to conform to the contour of the trench bottom and its purpose and function is that of a hopper, confining and dragging spoil along the bottom of the trench to produce a clean trench. Thus, the crumbing blade 17 is not powered and has dimensions slightly smaller than the trench dimension since it is not required to dig or smooth the trench bottom shape, that function being adequately performed by the digging tooth structure afforded by this invention. The semi-circular trench bottom is particularly advantageous for laying pipe, etc.

Figure 5:
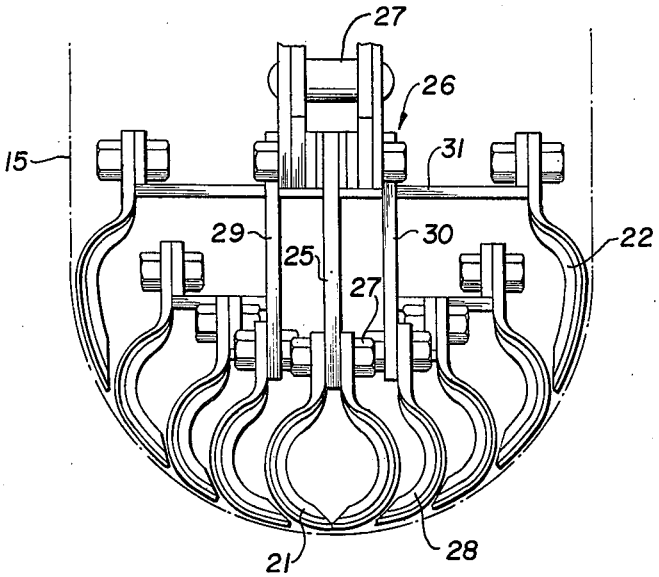
FIG. 5 is an end view of a set of teeth such as those shown in FIGS. 3 and 4 as seen when the teeth are presented along a straight line section of the chain link assembly, and omitting drag plate assemblies so that the relative arrangement of the teeth may be viewed in relation to the shape of the bottom of the trench shown in phantom line.

As may be seen by the profiles of FIGS. 1 and 5, each tooth assembly of the cyclically presented set of teeth 20 is different. Thus, as seen from the elevation profile, individual teeth are extended a different height or distance from the chain link assembly. Also as seen from the end view profile each digging bite is substantially circular and becomes progressingly larger from a tooth structure 21, which extends deepest into the trench and takes the smallest bite to the last tooth assembly 22 in the set which takes the widest bite. The design and shape of the teeth is such as to substantially distribute the digging load on each tooth assembly in the set and thereby smooth out intermittent load requirements from the power source 10. Thus the earth is cut in several stages by successively presented tooth assemblies of different configuration.

As seen from FIG. 5, tooth extension plates 25 may be affixed to the chain link assembly 26 driven by pin 27 and having the teeth bolted on (27) at the outer extremity. In the case of unitary teeth or separated teeth such as 28, etc., a pair of extension plates 29, 30 may be used, and separator plates 31 are used for lateral dimensioning. In particular as may be visualized from FIG. 1 sprocket assembly 14', the extension plate 25 provides an additional advantage in that it holds the digging tooth out far enough to have an added centrifugal force as it passes around the chain drive sprocket so that it tends to loosen and throw any accumulated spoil that might stick to the digging teeth.

Figure 3:
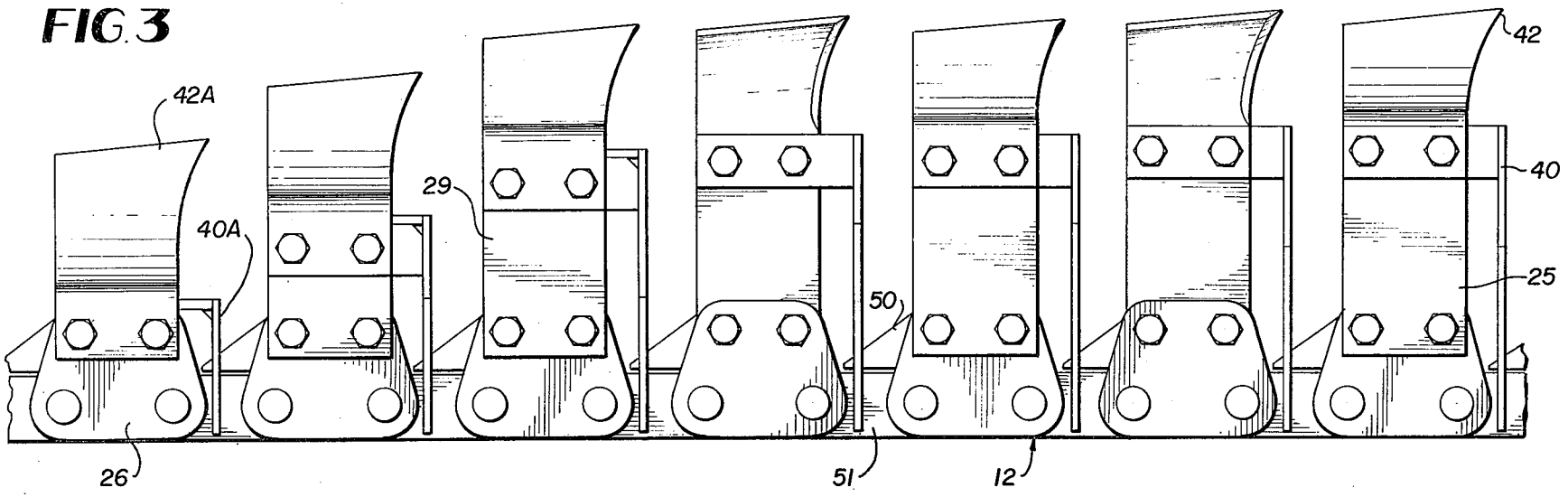
FIG. 3 is an elevation view of a set of sequentially presented digging teeth on a chain link drive mechanism as provided by this invention.
Figure 4:
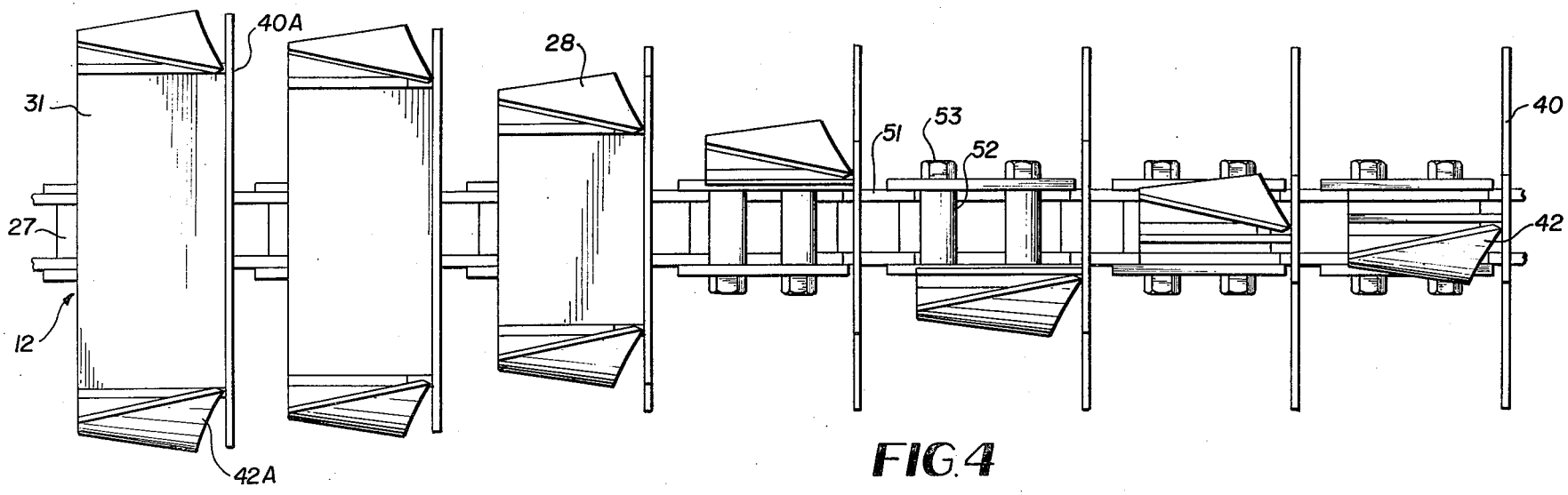
FIG. 4 is a plan view of the set of teeth shown in FIG. 3.

The arrangement and design of a typical set of digging teeth, as arrayed along a chain link drive mechanism 12, may be seen from FIGS. 3 and 4. The digging action may be viewed from FIG. 1 where successive teeth 21 of different sets are taking bites at the bottom of the trench 15 and along the front edge of the trench. Also, the other teeth are biting into the trench to increase the span or width of the trench. As the spoil is removed by the biting teeth, it is dragged along by drag plates 40 toward the top of the trench where it may be conveyed or passed into a disposal chute. Each drag plate 40, 40A, etc. is substantially the width of the trench and has a height related to the tooth height so that it will not interfere with the cutting bite on the outer cutting edges 42, 42A, etc. of the teeth.

In order to distribute the load imposed by the tooth assembly over a greater chain link length and hold the posture of the tooth so that it does not tilt under load, moment transfer structure 50, 51 is provided for each tooth. Thus, moment transfer plates 50 are bolted to chain spacer tubes 52 by bolts 53 to bear upon the chain link structure 51 intermediate the chain link structure portions of tooth assemblies 26. This serves therefore to distribute over an additional chain length the load caused by the digging moment exerted on cutting edge 42 for example, that would tend to urge the tooth assembly counter clockwise.

It is evident therefore from the foregoing description that this invention provides novel structure making trench digging machinery more efficient and effective in operation. For example, because of the distribution of digging load on successive teeth a smaller power source and lighter teeth than heretofore necessary may prove adequate for a particular job. Also because of the tooth-chain structure, a smaller and lighter chain may prove adequate to fulfill a given load, with attendant advantages of friction and power savings. Other advantages are also evident from the structural features set forth such as the lack of a power crumber or smoothing mechanism and the efficient production of a semi-circular trench bottom shape.

It is to be understood that the form of the invention herewith shown and described is to be taken as a preferred example of the same and that various changes in the shape, size and arrangement of parts may be resorted to without departure from the spirit of the invention or the scope of the subjoined claims.

What is claimed is:

1. A machine for digging trenches by cyclically movable mechanism mounted on a movable vehicle with a power source for moving said vehicle and mechanism comprising, in combination, a set of spaced, successive extension plates fixed to and extending outwardly to different heights from the top surface of said mechanism; arcuate tooth means mounted on the outer end of each of said plates to dig a trench thereby; each of said arcuate tooth means being successively larger than a preceding tooth means and the combination of said tooth means functioning to produce a semi-circular trench bottom and to distribute the digging load substantially uniformly to the power source as the machine is moved along the trench.

2. A machine as defined in claim 1 wherein said teeth means of smaller size have extension plates of greater height.

3. A machine as defined in claim 1 wherein each said tooth means has affixed thereto a drag plate substantially the width of the trench and extending over a portion of the height of the tooth means to thereby encounter spoil in the trench and carry it out of the trench.

4. A machine as defined in claim 3 including a crumber boom with a crumber plate extending into said trench bottom and of substantially the same width and shape as the trench bottom and disposed to follow said mechanism at a position closely adjacent to where the tooth means encounter the trench bottom thereby to provide a trench closure and to move any loose spoils with movement of said vehicle along said trench to said drag plates.

5. A machine as defined in claim 1 wherein said mechanism comprises a movable chain link assembly upon which said tooth means supporting extension plates are successively disposed and include moment transfer plates extending away from said extension plates substantially horizontally to the chain and in contact with the chain in positions where the tooth means are digging thereby distributing the bearing surface of said tooth means supporting extension plates over a greater portion of the length of said chain link assembly encompassing at least one further chain link.

6. A machine as defined in claim 1 wherein the mechanism comprises a chain link array which passes over a drive sprocket in a curved path of short radius such that the increased centrifugal force at said tooth means cutting surface caused by interspersing said extension plates serves to dislodge accumulated spoil from the cutting surface.

* * * * *